US005278542A

United States Patent [19]

Smith et al.

[11] Patent Number: 5,278,542

[45] Date of Patent: * Jan. 11, 1994

[54] MULTICOLOR DISPLAY SYSTEM

[75] Inventors: George C. Smith, College Station; Robert Bower, Jr., Bryan, both of Tex.

[73] Assignee: Texas Digital Systems, Inc., College Station, Tex.

[ * ] Notice: The portion of the term of this patent subsequent to Jul. 28, 2009 has been disclaimed.

[21] Appl. No.: 919,990

[22] Filed: Jul. 27, 1992

Related U.S. Application Data

[63] Continuation of Ser. No. 432,566, Nov. 6, 1989, Pat. No. 5,134,387.

[51] Int. Cl.[5] ..... G09G 1/28

[52] U.S. Cl. ..... 345/150; 345/83; 345/148

[58] Field of Search ..... 340/701, 702, 703, 762, 340/782, 815.03, 793, 767; 358/56

[56] References Cited

U.S. PATENT DOCUMENTS

| | | | |
|---|---|---|---|
| 3,740,570 | 6/1973 | Kaelin et al. . | |
| 3,909,788 | 9/1975 | Kaelin et al. | 358/241 |
| 4,367,464 | 1/1983 | Kurahashi et al. | 340/701 |
| 4,686.575 | 8/1987 | Shimada et al. | 340/766 |
| 4,687,340 | 8/1987 | Havel | 340/701 |
| 4,707,141 | 11/1987 | Havel | 340/701 |
| 4,755,807 | 7/1988 | Guennou | 340/708 |
| 4,794,383 | 12/1988 | Havel | 340/704 |
| 4,845,481 | 7/1989 | Havel | 340/762 |
| 4,967,373 | 10/1990 | Ginsburg | 340/703 |

*Primary Examiner*—Ulysses Weldon
*Assistant Examiner*—Doon Yue Chow
*Attorney, Agent, or Firm*—Glaser, Griggs & Schwartz

[57] ABSTRACT

A multicolor display system comprised of a matrix of light-emitting diodes (LEDs). Each display dot or pixel is comprised of one red LED and one green LED. The display data is stored in a selected one or more discrete locations of a random access memory as a bit map, depending upon the desired display color. Each memory location is associated with a particular primary color "field" (e.g., red or green). The bit map indicates which of the LEDs is ON and which is OFF in order to display selected data. The data associated with each field is displayed sequentially during a display cycle so that the relative mixture of red fields and green fields determines the resulting display color. The duty cycle of each LED is therefore controlled in software, which reduces the need for complex hardware such as voltage drivers and counters needed in prior art multicolor display systems.

20 Claims, 5 Drawing Sheets

| F1 (GREEN) | F2 (RED) | F3 (GREEN) | F4 (RED) |
|---|---|---|---|
| 11110 | 01111 | 10010 | 00101 |
| 11110 | 01111 | 10010 | 00101 |
| 11110 | 01111 | 10010 | 00101 |
| 11110 | 01111 | 10010 | 00101 |
| 11110 | 01111 | 10010 | 00101 |
| 11110 | 01111 | 10010 | 00101 |
| 11110 | 01111 | 10010 | 00101 |
| F5 (GREEN) | F6 (RED) | F7 (GREEN) | F8 (RED) |
|---|---|---|---|
| 10010 | 00111 | 10010 | 00101 |
| 10010 | 00111 | 10010 | 00101 |
| 10010 | 00111 | 10010 | 00101 |
| 10010 | 00111 | 10010 | 00101 |
| 10010 | 00111 | 10010 | 00101 |
| 10010 | 00111 | 10010 | 00101 |
| 10010 | 00111 | 10010 | 00101 |
FIG. 5
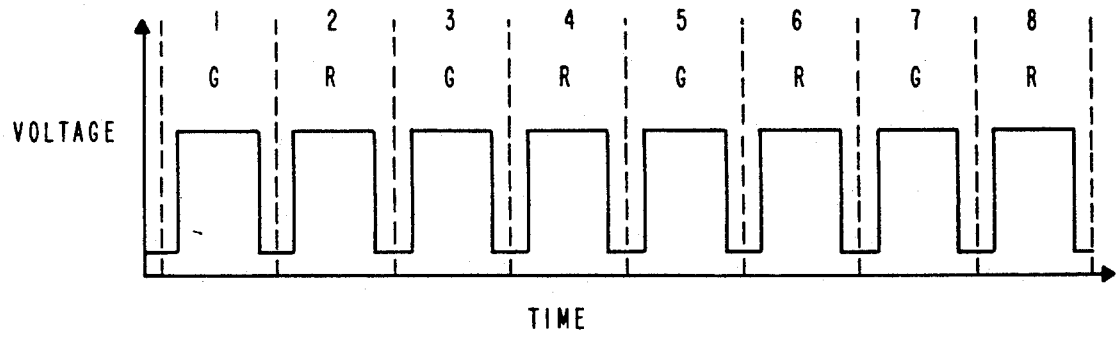
FIG. 6
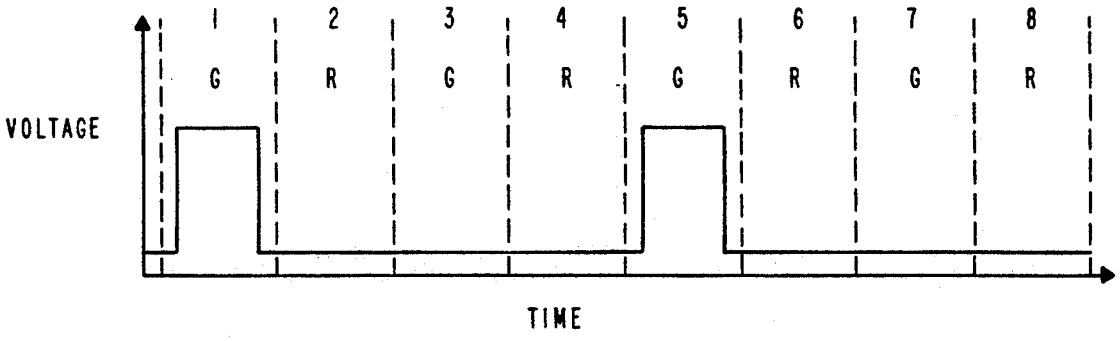
FIG. 7

MULTICOLOR DISPLAY SYSTEM

This is a continuation of application Ser. No. 432,566, filed Nov. 6, 1989 which issued on Jul. 28, 1992 as U.S. Pat. No. 5,134,387.

FIELD OF THE INVENTION

This invention relates to multicolor displays and in particular to a multicolor display system in which a plurality of color hues are displayable by varying the respective duty cycles of a plurality of primary color light-emitting devices.

BACKGROUND OF THE INVENTION

Light-emitting diodes (LEDs) are frequently used for alphanumeric displays, particularly in connection with computers and other data processing systems. LED displays may be comprised of a plurality of 7-segment fonts, whereby selected ones of the segments of each font are energized to display the desired alpha or numeric character. Alternatively, LEDs can be arranged in a conventional dot matrix pattern in which one or more LEDs are positioned at each "dot" of the display. Each dot represents a particular position on the display by column and row number.

Colored displays are desirable not only because of their esthetically pleasing appearance, but also because the different colors enable one to more easily distinguish between various portions of the information being displayed.

DESCRIPTION OF THE PRIOR ART

According to prior practice multicolor, LED displays typically include a discrete LED for each different color at each display position (pixel). For example, in a display having three primary colors, each pixel will have red, green and blue LEDs. Each of the LEDs is selectively energized to effect the desired display color at that particular position on the display.

For example, in U.S. Pat. No. 4,707,141, a hardware signal converter converts analog voltage to color control logic signals for controlling the color of various display segments. The analog input voltage is compared to a preset voltage and generates a preselected logic signal for displaying one color at a time, either red, green or yellow. Intermediate color shades are not available.

It is also known in the art to produce various shades of color on the display by varying the amount of time that each of the primary color LEDs is energized. In U.S. Pat. Nos. 4,794,383 and 4,687,340, the color control circuitry is comprised a of one or more counters which are programmed for a certain number of clock cycles corresponding to the time period that a primary color LED is to be energized. The number of clock cycles during each count cycle that each primary color LED is energized determines the relative intensities of the various primary colors and hence the resulting display color. During each counter cycle (i.e., 256 clock cycles), each color is ON continuously for a prescribed number of clock cycles and OFF continuously for a prescribed number of clock cycles.

Although some intermediate color shades are available, the color control circuitry shown in U.S. Pat. Nos. 4,794,383 and 4,687,340 would not be suitable for a display having a large number of pixels in which different colors are displayed simultaneously. Because the color control circuitry is hardware-implemented, separate drive circuitry would be required for each pixel or at least separate switching circuits would be required for each pixel in connection with a single color drive circuit. Because each pixel color is defined by the number of clock cycles that each of the primary colors is continuously ON during each counter cycle, the individual pixel colors would have to be defined sequentially and not simultaneously, unless separate drive circuitry were provided for each pixel. Although this might be practical for a display having a relatively small number of pixels, such as a four character timepiece display, as illustrated in these patents, this type of hardware-implemented color control circuitry would not be practical for a display having a large number of pixels (e.g., 560 pixels with two primary colors per pixel) in which different pixel colors can be simultaneously displayed.

In U.S. Pat. Nos. 3,909,788 and 3,740,570 color control circuitry is provided for selectively energizing diodes arranged in a matrix configuration. A first shift register supplies excitation and color control signals to the M rows of the matrix and a second register sequentially activates the energized diodes in each of the N columns of the matrix. Color and brightness are determined by the amplitude of the excitation current applied to the diodes. The duration of the control pulse determines the duration of each color. There is a separate drive transistor coupled to a different source of drive current for each of the three primary colors, red, green and yellow. No mention is made of having two or more primary color LEDs per pixel. These patents teach the use of storage registers and serial shift registers for color control, which would not be practical for large pixel displays. For example, a matrixed display of 40 columns$\times$ 14 rows $\times$8 possible color shades would require a storage register which is 4,480 bits long.

A major disadvantage of prior art LED displays is that the number of useful intermediate color shades that can be simultaneously displayed is limited, particularly when it is desired to have large numbers of pixels. Separate hardware driver circuitry is typically required for each of the primary colors and additional complex circuitry is required to generate logic control signals to vary the amount of time that each of the primary color LEDs is ON or OFF. This circuitry must often be repeated many times in order to simultaneously display different colors at different pixels.

OBJECTS OF THE INVENTION

It is, therefore, the principal object of the present invention to provide an improved multicolor display system.

Another object of the invention is to provide a multicolor LED display in which the individual LEDs are selectively energized and de-energized using software-generated control signals.

Yet another object of the invention is to simplify the hardware driver circuitry used to control a multicolor LED display system.

Still another object of the invention is to provide a multicolor LED display system in which a greater number of intermediate color shades can be displayed simultaneously.

SUMMARY OF THE INVENTION

These and other objects are accomplished in accordance with the present invention in which a multicolor display system is provided. The display system is comprised of a plurality of display elements, each of which includes a plurality of electrically activatable light-emitting devices for emitting light of respective primary colors; display activation means for activating a selected one or more of the display elements by periodically activating a selected one or more of the corresponding light-emitting devices; storage means for storing a plurality of discrete codes, each of which corresponds to a discrete time interval of a display refresh cycle and indicates whether or not each of the light-emitting devices of a particular primary color is to be activated during the corresponding discrete time interval; and control means responsive to each of the discrete codes for controlling the display activation means to activate each of the selected one or more of the light-emitting devices during a selected one or more of the discrete time intervals. The display refresh cycle corresponds to a time period equal to the reciprocal of an activation frequency at which the selected one or more of the display elements is periodically activated, such that an image displayed by the activation of the selected one or more of the display elements appears to a human eye to be continuously displayed.

In accordance with a unique feature of the invention, the light-emitting devices of each primary color are activatable during a plurality of discrete time intervals of the refresh cycle. The intensity of the color emitted by each of the selected one or more of the light-emitting devices is partially defined during each discrete time interval corresponding to the primary color of the corresponding light-emitting device, such that the intensity of the color of each of the selected one or more of the light-emitting devices is separately definable during the refresh cycle from the intensity of the color of any other of the selected one or more of the light-emitting devices of the same primary color. The color of each of the selected one or more of the display elements is defined by the number of discrete time intervals of the refresh cycle that each of the light-emitting devices of the corresponding display element is activated. The control means therefore provides separate color control of each display element such that an image is displayable which appears to the human eye to be continuously displayed in a plurality of colors. Consecutive ones of the discrete time intervals corresponding to each primary color are preferably punctuated by at least one intermediate discrete time interval corresponding to another primary color.

BRIEF DESCRIPTION OF THE DRAWINGS

Further objects and advantages of the invention will be apparent from the Detailed Description and Claims when read in conjunction with the accompanying drawings wherein:

FIG. 5 shows sample bit maps for different color fields;

FIGS. 6-8 are respective voltage-timing diagrams, illustrating various combinations of primary colors to produce desired intermediate color hues; and, FIG. 9 illustrates the respective time durations of the various color fields when the fields are "weighted" in a binary manner.

DETAILED DESCRIPTION OF THE PREFERRED EMBODIMENT

In the description which follows, like parts are marked throughout the Specification and Drawings, respectively. The Drawings are not necessarily to scale and in some instances proportions have been exaggerated in order to more clearly depict certain features of the invention.

Figure 1:
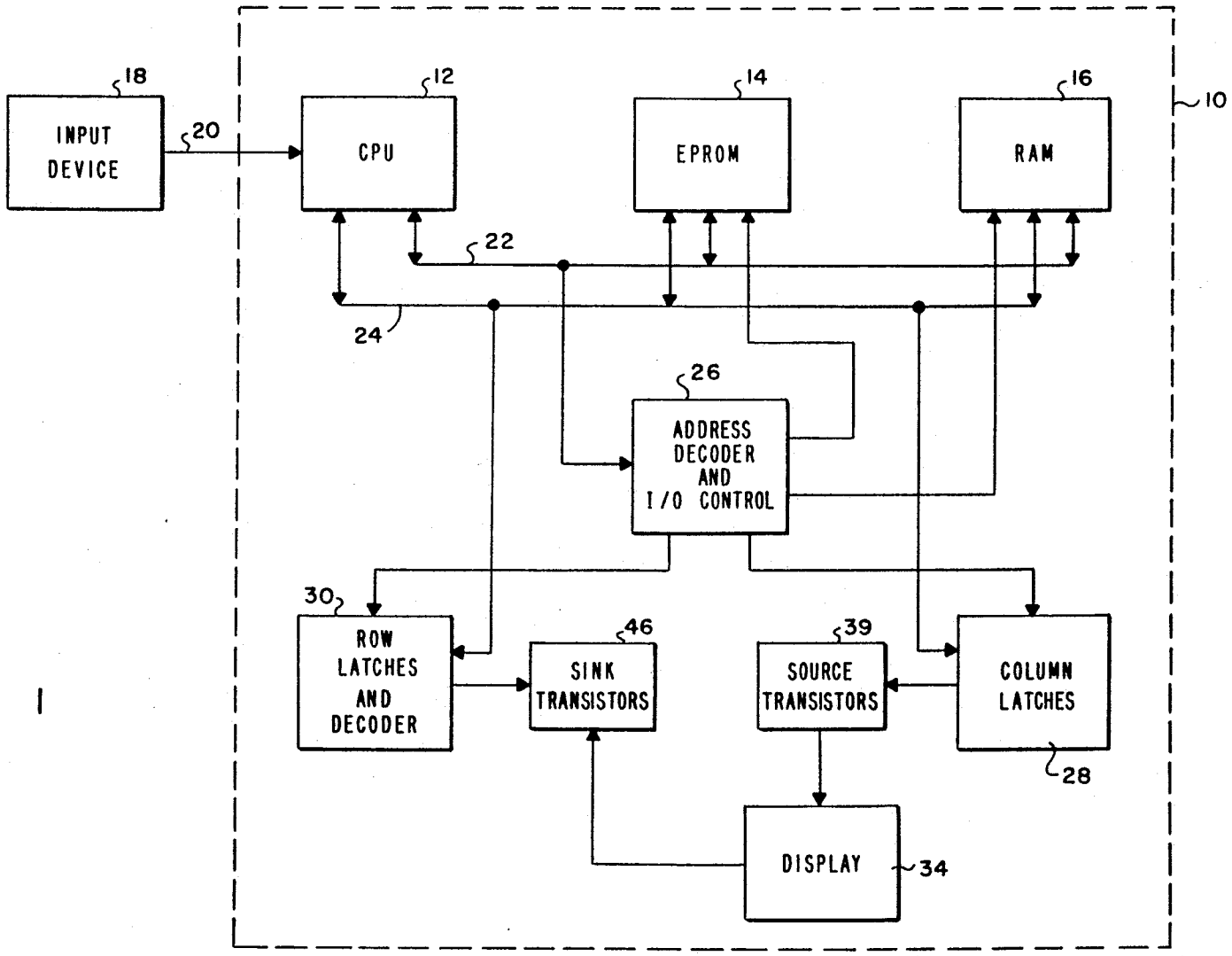
FIG. 1 is a simplified block diagram of the display system according to the present invention, showing an interface between the display system and an input device, such as a computer.

Referring to FIG. 1, a display system 10 according to the present invention includes a central processing unit (CPU) 12, an erasable, programmable read only memory (EPROM) 14 and a random access memory (RAM) 16. CPU 12, which is preferably a microprocessor of the Z 80180 type, manufactured and sold by Zilog Corporation, receives signals from an input device 18, such as a computer, via an RS 232 interface 20, which corresponds to the information to be displayed. The information transmitted to CPU 12 includes the particular alpha, numeric or graphic characters to be displayed and the color in which the characters are to be displayed. The color data, which may be a 7-bit data word, will typically be transmitted first, followed by the data corresponding to the particular alpha or numeric characters to be displayed.

The display control program is evident in EPROM 14. CPU 12 will initialize the control program by generating an address signal on address bus 22. EPROM 14 will generate a digital (binary) code representing a particular character to be displayed. The binary code retrieved from EPROM 14 is then loaded into RAM 16 via data bus 24. The binary code indicative of the character to be displayed is loaded into one or more bit-mapped fields in RAM 16, depending upon the color in which the particular character is to be displayed. Address bus 22 is coupled to an address decoder and input/output (I/O) control 26, which decodes the address signal and determines whether CPU 12 is communicating with EPROM 14, RAM 16 or respective column and row latches 28 and 30.

Figure 3:
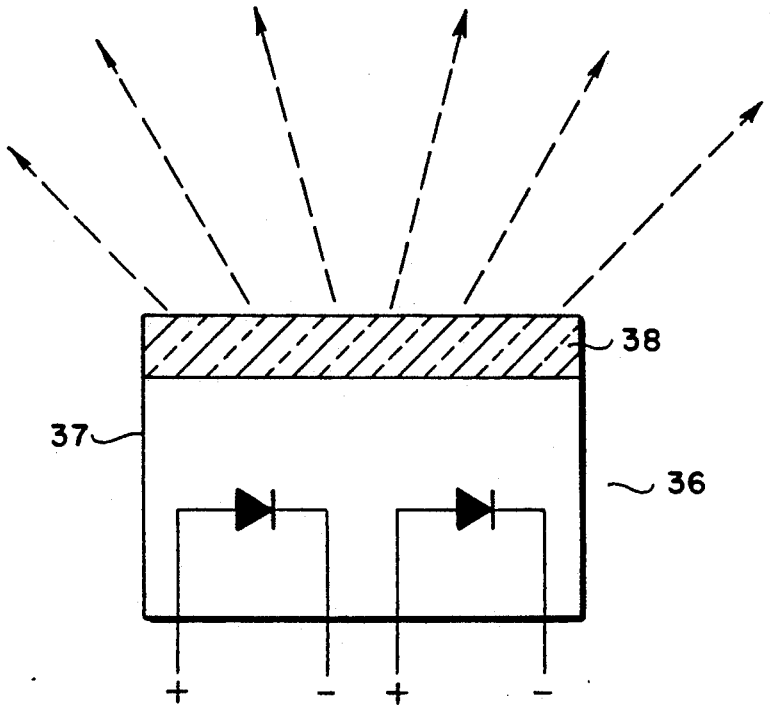
FIG. 3 is a simplified circuit diagram of a display element.
Figure 4:
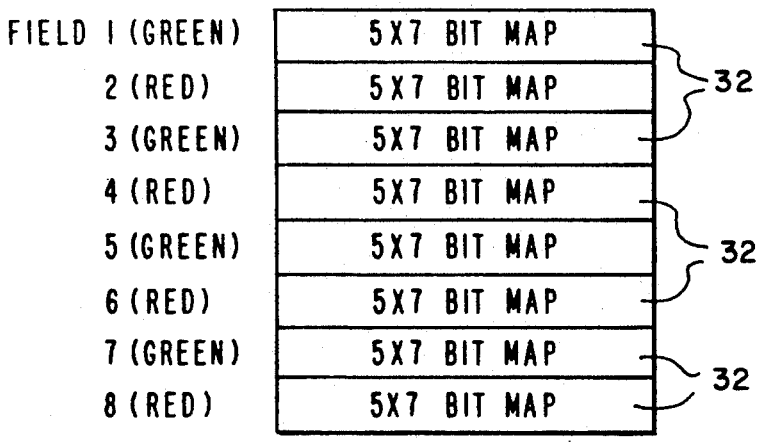
FIG. 4 is a memory map diagram, illustrating the discrete RAM regions assigned to the various color fields.

Referring to FIG. 4, each bit-mapped field 32 occupies a discrete region of RAM 16. Each field 32 is associated with a particular primary color, such as red or green. One skilled in the art will appreciate that three primary colors (i.e., red, green and blue) can be used to provide even more intermediate color shades, but the description which follows will be with reference to red and green as the two primary colors. In the example shown in FIG. 3, field 1 is associated with green, field 2 with red, field 3 with green, field 4 with red and so on up to the total number of fields, which in this example is 8. The number of fields can be more than or fewer than 8, but 8 fields will be used as an example. Increasing the number of fields has the advantage of greater control over the intermediate colors produced by mixing the primary colors, but the use of too many fields will cause the display to "flicker" when the percentage of time that each display dot is ON is too low in relationship to the response time of the human eye. Hence, it has been determined that the use of 8 fields provides a proper balance when two primary colors are used.

Figure 9:
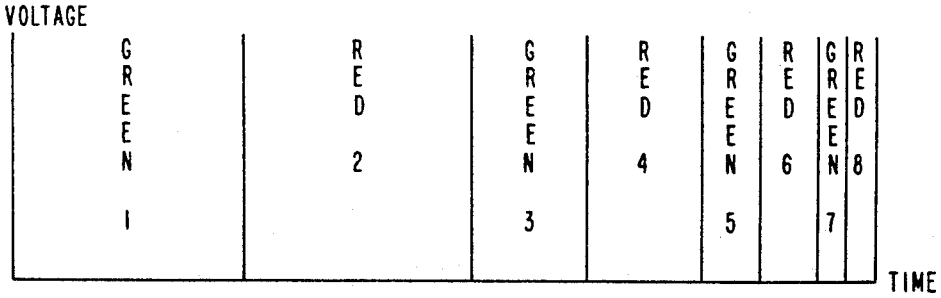

For a given amount of memory space (i.e., a given number of memory bits), the number of possible colors can be increased by "weighting" the various fields in a binary manner. For example, the time duration of Field 1 (Green) may be equal to the duration of Field 2 (Red); the time duration of Field 3 (Green) and Field 4 (Red) may be ½ of Field 1; the duration of Field 5 (Green) and Field 6 (Red) may be ¼ that of Field 1; and the duration of Field 7 (Green) and Field 8 (Red) may be equal to ⅛ that of Field 1. The time durations of each of the fields is illustrated in FIG. 9.

The human eye averages the voltage pulses generated during the various fields and is able to perceive 16 different intensity levels for each primary color. Thus, the 4 bits associated with the 4 green fields (for a given pixel) now yield 16 discrete intensity levels of green (0–15). Likewise, the 4 bits associated with the 4 red fields (for a given pixel) now yield 16 discrete intensity levels of red (0–15). One skilled in the art will appreciate that by increasing the number of bits assigned to each primary color (e.g., from 4 bits to 8 bits), the number of intermediate color shades detectable by the human eye can be increased exponentially, such that the number of detectable color shades would be $2^p$, where p is the number of bits or fields assigned to each primary color. This variation can be accomplished in software and by providing sufficient memory space to store the number of bits required.

Figure 2:
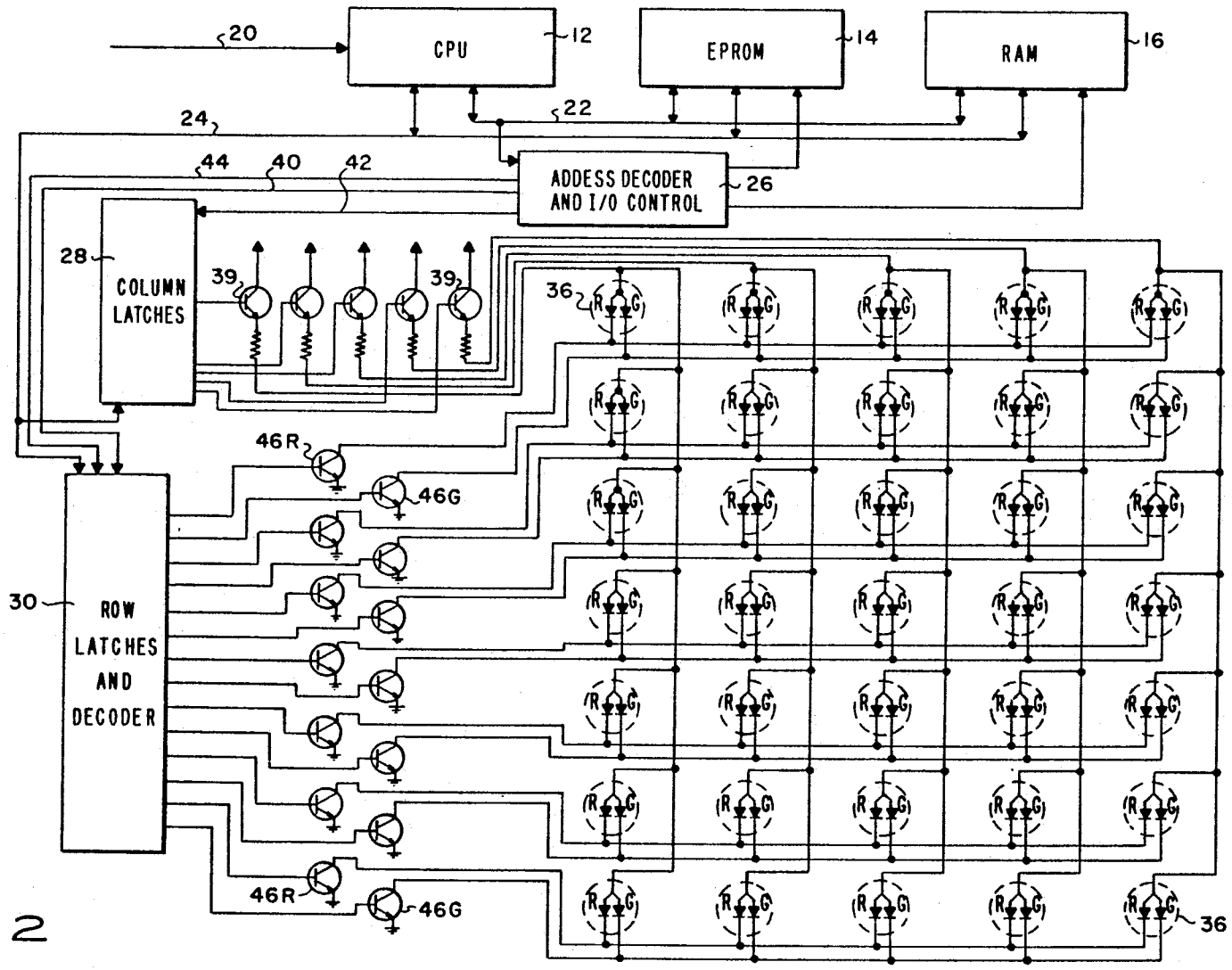
FIG. 2 is a circuit diagram of the display system according to the present invention.

Referring to FIGS. 1–3, display 34 is preferably comprised of an M column by N row matrix display (e.g., 5×7 dot matrix). Each display dot 36 is comprised of a red diode R and a green diode G, which are disposed within a housing 37. A top part of housing 37 includes a diffusion filter 38 for diffusing the light emitted by diodes R and G. Each display dot 36 occupies a discrete column (vertical) coordinate and row (horizontal) coordinate. Because the display LEDs are matrixed, they cannot be activated continuously, but rather are scanned at a predetermined rate. Each dot 36 must be "refreshed" often enough to insure that the display does not appear to "flicker" to the human eye. It has been found that a refresh (display) cycle of approximately 1/85 second will prevent the display from flickering, while consuming minimal power.

During each refresh cycle (e.g., 1/85 second), each of the bit-mapped fields 32 will be displayed in sequence for a predetermined time interval. Furthermore, during the time that each field 32 is being displayed, each of the 7 rows is sequentially scanned, so that CPU 12 is interrupted a number of times per second equal to 85×P×N, where P is the number of color fields 32 (e.g., 8) and N is the number of rows (e.g., 7).

Referring specifically to FIG. 2, red LED R and green LED G at each display dot 36 are coupled at their respective anodes to the respective anodes of each of the other 6 pairs of LEDs in the same column. The respective anodes of all of the LEDs in the same column are in turn coupled to the corresponding column latch 28 via a corresponding current source transistor 39. Respective current limiting resistors 41 are in series between the respective emitters of current source transistors 39 and the respective columns. The respective collectors of current source transistors 39 are connected to a voltage source V to provide working current. Current source transistors 39 are turned ON and OFF by the respective column latches 28.

To initialize operation, CPU 12 sends a "Blank Display" signal via address decoder and I/O control 26 on conductor 40 to row latches and decoder 30. CPU 12 then addresses RAM 16 to retrieve a particular bit map 32 for the first display field beginning with the first row of LEDs.

Referring to FIG. 5, examples of 8 different bit maps for the 8 different fields are shown. In each bit map, one bit is associated with each display pixel. The pixels are activated substantially simultaneously during each display field. The bit maps depicted in FIG. 5 would display a vertical green line (note the "1" bits in the first column of the green fields), next to a vertical brown line (note the "1" bits in the second column of the first green and red fields), next to a vertical orange line (note the "1" bits in the third column of the first green field and in all four red fields), next to a vertical yellow line (note the "1" bits in the fourth column of all the green fields and in the first and third red fields), next to a red line (note the "1" bits in the fifth column of all the red fields).

The data for the first row is loaded into column latches 28 via data bus 24. A "Column Select" signal is transmitted by address decoder and I/O control 26 via conductor 42 to indicate that the data is to be temporarily stored for display in column latches 28. A "1" bit is latched for each column which is to be lit. The "1" bit in turn activates the corresponding current source transistor 39.

Similarly, a "Row Select" signal is transmitted via conductor 44 to row latches and decoder 30 to indicate that a particular signal (typically a scanning signal) transmitted on data bus 24 by CPU 12 is addressed to row latches and decoder 30. Each row has two current sink transistors 46 associated therewith. One current sink transistor 46R is associated with the "red fields" and the other current sink transistor 46G is associated with the "green fields". Row latches and decoder 30 include demultiplexing circuitry for demultiplexing incoming signals on data bus 24.

The seven rows of display 34 are activated sequentially, beginning with Field 1 (Green) and Field 2 (Red). The portion of the Field 1 bit map associated with row 1 is displayed, followed by a portion of the Field 2 bit map associated with row 1. The Field 1 and Field 2 data bits associated with row 2 are then displayed in sequence and so on for all seven rows. After the Field 1 and Field 2 data associated with all seven rows has been displayed, Field 3 (Green) and Field 4 (Red) are displayed in sequence for all seven rows. The refresh sequence continues for all eight fields, as described above.

By selecting different combinations of red and green fields, different intermediate colors can be displayed. For example, when 8 fields are used (4 red fields and 4 green fields), a total of 23 different display colors can be achieved.

Figure 8:
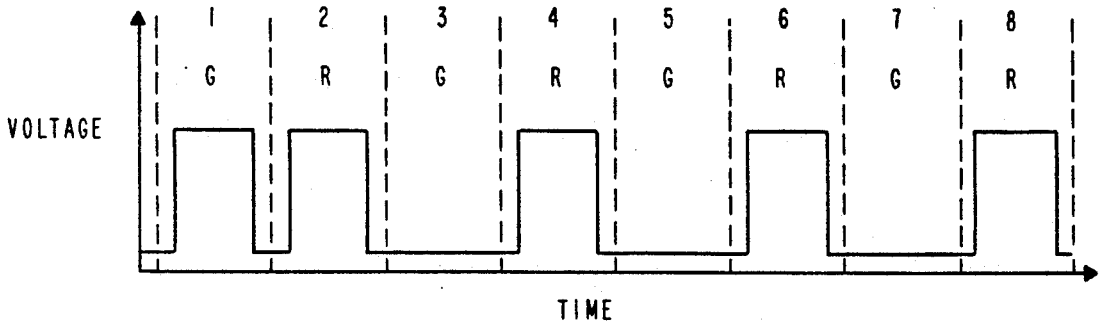

Referring to FIGS. 6–8, three different examples of how the red and green fields can be mixed to achieve a desired intermediate color are illustrated. In FIG. 6, the red and green fields are alternated so that the red LEDs and green LEDs are displayed for substantially equal times. This combination produces a bright amber color display. In FIG. 7, none of the red LEDs is illuminated and the green LEDs are illuminated only during the first and fifth fields. This pattern produces an olive green colored display. In FIG. 8, the green LEDs are activated during only one field and the red LEDs are activated during four fields, thereby resulting in a bright orange colored display.

The multicolor display system according to the present invention provides several advantages over prior art display systems. Prior art methods of "refreshing" the display pixels involve completely (and continuously) "defining" the color of each pixel before proceeding to refresh the next pixel. Such prior art systems operate on the principle that the human eye can "scan" from one pixel to the next, such that all the pixels appear to be lit at the same time. However, in displays having a large number of pixels, the intermediate color shades achieved by varying the respective duty cycles of the individual LEDs are not distinct.

The display system according to the present invention refreshes all of the pixels substantially simultaneously and achieves a large number of intermediate color shades by varying the respective duty cycles of the LEDs in software. This is achieved by the various color fields comprising the display cycle. As a result, the human eye is used not only in scanning from row to row in the display, but also to define the color of the pixel. Therefore, large numbers of intermediate color shades can be simultaneously displayed in connection with displays having large numbers of pixels. The multicolor display system according to the present invention is particularly well-suited to graphics applications, where low-cost, relatively simple circuitry is required and fast, sophisticated color control is essential.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. A multicolor display system, comprising, in combination:

a plurality of display elements, each of which includes a plurality of electrically activatable light-emitting devices for emitting light of respective primary colors;

display activation means for activating a selected one or more of said display elements by periodically activating a selected one or more of the corresponding light-emitting devices at an activation frequency such that an image displayed by the activation of said selected one or more of said display elements appears to a human eye to be continuously displayed, a time period equal to the reciprocal of the activation frequency corresponding to a refresh cycle of said display system;

storage means for storing a plurality of discrete codes, each of said discrete codes corresponding to a discrete time interval of the refresh cycle and indicating whether or not each of the light-emitting devices of a particular primary color is to be activated during the corresponding discrete time interval, the light-emitting devices of only one primary color being activatable during each discrete time interval, the light-emitting devices of each primary color being activatable during a plurality of discrete time intervals of the refresh cycle; and control means responsive to each of said discrete codes for controlling said display activation means to activate each of said selected one or more of said light-emitting devices during a selected one or more of said discrete time intervals, the intensity of the color emitted by each of said selected one or more of said light-emitting devices being partially definable during each discrete time interval corresponding to the primary color of the corresponding light-emitting device such that the intensity of the color of each of said selected one or more of said light-emitting devices is separately definable during the refresh cycle from the intensity of the color of any other of said selected one or more of said light-emitting devices of the same primary color, the color of each of said selected one or more of said display elements being definable by the number of discrete time intervals of the refresh cycle that each of said light-emitting devices of the corresponding display element is activated, said control means providing separate color control of each display element such that an image is displayable which appears to the human eye to be continuously displayed in a plurality of colors.

2. The display system of claim 1 wherein said storage means includes a plurality of discrete storage locations, each of said storage locations being adapted for storing a corresponding discrete code.

3. The display system of claim 1 wherein said plurality of display elements is comprised of $M \times N$ number of display elements arranged in a matrix of M number of columns and N number of rows, M and N being integers, said display system further including first driver means for applying a discrete electrical signal to each of said M columns in accordance with each of said discrete codes and second driver means for sequentially scanning the N rows.

4. The system of claim 3, wherein said first driver means is comprised of first latch means for temporarily storing display data and M number of electrical current supply devices connected between said first latch means and the respective M columns for supplying electrical current to the display elements of the respective columns, said current supply devices being controlled by the first latch means to supply electrical current to a selected one or more of the columns in accordance with the display data stored in the first latch means, said second driver means being comprised of second latch means for applying a scanning signal in sequence to the N rows and N groups of switching devices connected between the second latch means and the respective N rows for selectively activating and deactivating the display elements of the respective rows, the individual switching devices of each group being coupled to the light-emitting devices of the respective primary colors in the corresponding row so that the light-emitting devices of each primary color are separately controllable.

5. The system of claim 4, wherein each display element is comprised of P number of light-emitting diodes for emitting light of respective P number of primary colors, the respective anodes of the light-emitting diodes in the same column being commonly coupled to the corresponding current supply device, the respective cathodes of the light-emitting diodes of a particular primary color in the same row being commonly coupled to the corresponding switching device.

6. The system of claim 5, wherein each current supply device is comprised of a current supply transistor, the base of which is connected to the first latch means, the emitter of which is coupled to the respective anodes of the light-emitting diodes of the corresponding column and the collector of which is connected to a source of working electrical current.

7. The display system of claim 6, further including a current limiting resistor in series between each of the current supply devices and the respective anodes of the light-emitting diodes of the corresponding column.

8. The display system of claim 6, wherein each switching device is comprised of a current sink transistor, the base of which is connected to the second latch means, the emitter of which is grounded and the collector of which is coupled to the respective cathodes of the light-emitting diodes of the corresponding primary color in the corresponding row.

9. The display system of claim 1 wherein said storage means includes a plurality of discrete storage locations, each of said storage locations being adapted for storing a particular one of said discrete codes, each discrete time interval being associated with a corresponding discrete storage location.

10. The display system of claim 9 wherein the light-emitting devices of each primary color are activatable during an equal number of discrete time intervals of the refresh cycle.

11. The display system of claim 1 wherein each of said discrete time intervals corresponds to a discrete color field, the time duration of each discrete color field corresponding to a particular primary color being different from the time duration of each of the other discrete color fields corresponding to the same particular primary color, such that the human eye can detect $2^n$ number of different intensities of each primary color, where n is the number of discrete color fields associated with each primary color during the refresh cycle.

12. The display system of claim 1 wherein the time duration of each discrete time interval is independent of a selected color to be displayed.

13. A method of controlling the color of a multicolor display system having a plurality of display elements, each display element having a plurality of electrically activatable light-emitting devices for emitting light of respective primary colors, said method comprising the steps of:

dividing a predetermined time period corresponding to a refresh cycle of the display elements into a plurality of discrete time intervals, the refresh cycle corresponding to a time period between successive activations of a selected one or more of said display elements such that an image displayed by the activation of said selected one or more of said display elements appears to a human eye to be continuously displayed, each of said discrete time intervals corresponding to a particular one of the primary colors, such that the light-emitting devices of only one primary color are activatable during each discrete time interval, the light-emitting devices of each primary color being activatable during a plurality of discrete time intervals of the refresh cycle;

providing a plurality of discrete codes, each of said discrete codes corresponding to a discrete time interval of the refresh cycle and indicating whether or not each of the light-emitting devices of a particular primary color is to be activated during the corresponding discrete time interval; and controlling the activation of said display elements in accordance with said discrete codes by periodically activating a selected one or more of said light-emitting devices during a selected one or more of said discrete time intervals, the intensity of the color emitted by each of said selected one or more of said light-emitting devices being partially definable during each discrete time interval corresponding to the primary color of the corresponding light-emitting device such that the intensity of the color of each of said selected one or more of said light-emitting devices is separately definable from the intensity of the color of any other of said selected one or more of said light-emitting devices of the same primary color, the color of each activated display element being definable by the number of discrete time intervals of the refresh cycle that each of the light-emitting devices of the corresponding display element is activated, to provide separate color control of each display element such that an image is displayable which appears to the human eye to be continuously displayed in a plurality of colors.

14. The display system of claim 13 wherein the time duration of each discrete time interval is independent of a selected color to be displayed.

15. The method of claim 13 wherein said display system includes storage means having a plurality of discrete storage locations, each of said storage locations being adapted for storing a corresponding discrete code, said method including storing each of said discrete codes in a corresponding one of said discrete storage locations.

16. The method of claim 13 wherein said plurality of display elements is comprised of $M \times N$ number of display elements, M and N being integers, display elements being arranged in a matrix of M columns and N rows, said controlling including applying respective discrete electrical signals to said M columns in accordance with said discrete codes and sequentially scanning said N rows.

17. The method of claim 13 wherein the light-emitting devices of each primary color are activatable during an equal number of discrete time intervals of the refresh cycle.

18. In a multicolor display system having a plurality of display elements, each of which has a plurality of electrically activatable light-emitting devices for emitting light of respective primary colors, control means for selectively activating and deactivating the light-emitting devices in accordance with predetermined display parameters, and memory means having a plurality of discrete storage locations, a method of controlling the color of each of the display elements, comprising the steps of:

dividing a predetermined time period corresponding to a refresh cycle of said display elements into a plurality of discrete time intervals, the refresh cycle corresponding to a time period between successive activations of a selected one or more of said display elements such that an image displayed by the activation of said selected one or more of said display elements appears to a human eye to be continuously displayed, each of said discrete time intervals corresponding to a particular one of said discrete primary colors, such that the light-emitting devices of only one primary color are activatable during each discrete time interval, the light-emitting devices of each primary color being activatable during a plurality of discrete time intervals of the refresh cycle;

providing a plurality of discrete codes, each of said discrete codes corresponding to a discrete time interval of the refresh cycle and indicating whether or not each of the light-emitting devices of a particular primary color is to be activated during the corresponding discrete time interval;

allocating each of said discrete storage locations to a particular one of said discrete time intervals and storing the corresponding discrete code in the corresponding discrete storage location; and controlling the activation of said display elements in accordance with said discrete codes by periodically activating a selected one or more of said light-emitting devices during a selected one or more of said discrete time intervals, the intensity of the color emitted by each of said selected one or more of said light-emitting devices being partially definable during each discrete time interval corresponding to the primary color of the corresponding light-emitting device such that the intensity of the color of each of said selected one or more of said light-emitting devices is separately definable from the intensity of the color of any other of said selected one or more of said light-emitting devices of the same primary color, the color of each activated display element being definable by the number of discrete time intervals of the refresh cycle that each of the light-emitting devices of the corresponding display element is activated, to provide separate color control of each display element such that an image is displayable which appears to the human eye to be continuously displayed in a plurality of colors.

19. The method of claim 18 further including the step of allocating to each primary color an equal number of discrete time intervals of the refresh cycle.

20. The display system of claim 18 wherein the time duration of each discrete time interval is independent of a selected color to be displayed.

* * * * *